US008833352B2

(12) United States Patent
Pham et al.

(10) Patent No.: US 8,833,352 B2
(45) Date of Patent: Sep. 16, 2014

(54) METHOD AND APPARATUS FOR CONTROLLING PAINTBALL LOADING USING A DETENT

(75) Inventors: Loc T. Pham, San Jose, CA (US); Omar Alonso Macy, San Jose, CA (US); Khanh Tran, San Jose, CA (US)

(73) Assignee: Real Action Paintball (RAP4), Inc., Gilroy, CA (US)

( * ) Notice: Subject to any disclaimer, the term of this patent is extended or adjusted under 35 U.S.C. 154(b) by 346 days.

(21) Appl. No.: 13/168,632

(22) Filed: Jun. 24, 2011

(65) Prior Publication Data

US 2012/0325192 A1 Dec. 27, 2012

(51) Int. Cl.
*F41B 11/02* (2006.01)
*F41B 11/50* (2013.01)

(52) U.S. Cl.
CPC ..... *F41B 11/50* (2013.01)
USPC ..... 124/73

(58) Field of Classification Search
USPC ..... 124/41.1, 47, 82, 51.1, 83–85, 81, 80, 124/71–76, 49
See application file for complete search history.

(56) References Cited

U.S. PATENT DOCUMENTS

| | | | | | |
|---|---|---|---|---|---|
| 2,182,369 | A * | 12/1939 | Barron | 124/81 |
| 3,662,729 | A * | 5/1972 | Henderson | 124/73 |
| 3,756,001 | A * | 9/1973 | Macidull | 56/328.1 |
| 3,765,396 | A * | 10/1973 | Kienholz et al. | 124/65 |
| 4,091,791 | A * | 5/1978 | Castelli et al. | 124/73 |
| 5,280,778 | A * | 1/1994 | Kotsiopoulos | 124/73 |
| 5,327,878 | A * | 7/1994 | Wittbrot | 124/41.1 |
| 5,450,838 | A * | 9/1995 | Nakahigashi et al. | 124/56 |
| 5,497,758 | A * | 3/1996 | Dobbins et al. | 124/73 |
| 5,515,838 | A * | 5/1996 | Anderson | 124/76 |
| 5,655,510 | A * | 8/1997 | Kunimoto | 124/81 |
| 6,561,176 | B1 * | 5/2003 | Fujimoto et al. | 124/76 |
| 6,860,258 | B2 * | 3/2005 | Farrell | 124/51.1 |
| 7,231,914 | B2 * | 6/2007 | Hatcher | 124/83 |
| 7,387,117 | B2 * | 6/2008 | Kunimoto | 124/73 |
| 7,686,004 | B2 * | 3/2010 | Gan | 124/75 |
| 8,006,681 | B2 * | 8/2011 | Chen | 124/73 |
| 2007/0151549 | A1 * | 7/2007 | Wood | 124/73 |
| 2009/0235909 | A1 * | 9/2009 | Lian | 124/51.1 |
| 2010/0313866 | A1 * | 12/2010 | Chen | 124/73 |

* cited by examiner

*Primary Examiner* — Reginald Tillman, Jr.
(74) *Attorney, Agent, or Firm* — James M. Wu; JW Law Group

(57) ABSTRACT

A paintball assembly capable of retaining a paintball in a loading chamber using a paintball catcher is disclosed. The paintball assembly includes a loading chamber, a detent, and a bolt. The loading chamber is coupled to a loading port to receive paintballs. In one embodiment, the detent includes a paintball catcher capable of catching the paintball as it is loaded into the loading chamber. In one example, the paintball catcher is a flexible paintball catcher extending into the loading chamber and is able to catch the paintball and hold it in a predefined position. When a trigger is pulled, the bolt pushes the paintball into a firing chamber while the paintball catcher releases the paintball.

18 Claims, 12 Drawing Sheets

METHOD AND APPARATUS FOR CONTROLLING PAINTBALL LOADING USING A DETENT

FIELD

The present invention relates to paintball guns, paintball assemblies, or paintball markers. More specifically, the present invention relates to paintball and/or projectile propelling mechanisms.

BACKGROUND

With increasing popularity of paintball tournaments as well as professional trainings such as military and athletic competitions, more accurate and realistic looking paintball guns or markers are in demand. For example, success in training or competition typically rests largely upon the speed in which an operator of a paintball marker can eliminate opponents by marking them with paint via paintballs or paint projectiles. A problem associated with a conventional paintball marker is ball damage (or chop) before it is launched or propelled by a marker.

A conventional paintball gun or marker typically loads the paintball into a loading chamber either by gravity from a top-load hopper, or by forced-fed loaders from a magazine. After loading, pressurized gas is guided through the control of a firing mechanism to propel the paintball out of the barrel. A problem associated with a conventional paintball marker is that as the paintball marker being carried and moved around, the paintball in the loading chamber may be dislodged from its original intended loading position, and may become misaligned with the firing mechanism. For example, when a bolt hits or impacts a paintball which is misaligned with the barrel or the barrel coupling system, the paintball may be chopped before it leaves the gun through the barrel. As a result, misaligned paintballs are often chopped or crushed inside the paintball gun during the process of firing or launching.

Another drawback associated with a conventional paintball marker is that the paintball in the loading chamber may move into the gun barrel prematurely due to the movement of the marker. For example, when the gun barrel is pointed downward, the paintball in the loading chamber may roll out of the barrel. Chopped and/or leaking paintballs can jam the firing mechanism of the marker causing it malfunction.

SUMMARY

Embodiments of the present invention disclose a paintball assembly capable of receiving a paintball in the loading chamber and retaining the paintball in a predefined position in the chamber until it is launched by the firing mechanism. The paintball assembly includes a loading chamber, a detent, and a bolt wherein the loading chamber is coupled to a loading port to receive paintballs. In one embodiment, the detent includes a paintball catcher capable of catching the paintball as it is loaded into the loading chamber. In one example, the paintball catcher is a flexible paintball catcher extending into the loading chamber and is able to catch the paintball and hold it in a predefined position. When a trigger is pulled, the bolt pushes the paintball into a firing chamber while the paintball catcher releases the paintball.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1A:
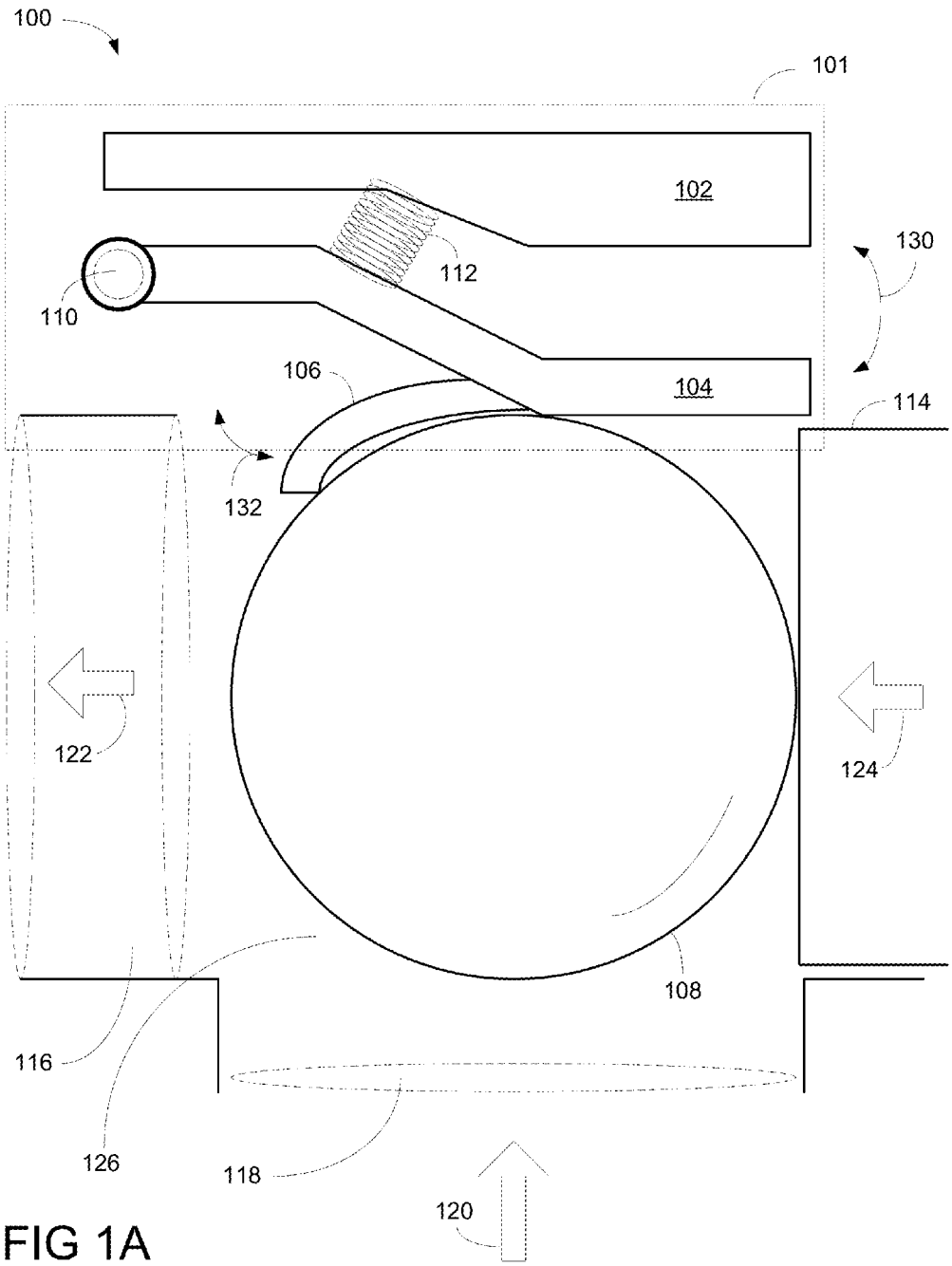
FIG. 1A is a diagram illustrating a paintball assembly having a detent for restraining movement of a paintball in accordance with one embodiment of the present invention.

Exemplary embodiment(s) of the present invention is described herein in the context of a method, system and apparatus of controlling a paintball in a loading chamber using a detent having a paintball catcher.

Those of ordinary skills in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

Embodiments of the present invention disclose a paintball assembly or paintball gun configured to position a paintball at a predefined location in a loading chamber using a detent. The paintball assembly includes a loading chamber, a detent, and a bolt wherein the loading chamber is further coupled to a loading port to receive paintballs. In one embodiment, the detent having a paintball catcher is capable of catching a paintball as it moves into the loading chamber. The paintball catcher, which can be flexible, extends into the loading chamber to hold and position a paintball in a predefined location. Upon pulling the trigger of a paintball gun, while the paintball catcher releases the paintball, the bolt pushes the paintball into a firing chamber for launching. It should be noted that the terms "paintball marker," "paintball gun," and "paintball assembly" are used interchangeably herein.

FIG. 1A is a diagram 100 illustrating a paintball assembly having a detent for restraining movement of a paintball in accordance with one embodiment of the present invention. Diagram 100 includes a detent 101, a loading chamber 126, a paintball 108, and a bolt 114. While one side of the loading chamber 126 couples to a loading port 118, a second side of the loading chamber 126 couples to a barrel coupling system 116. Barrel coupling system 116, in one example, includes a coupling device as such threads used for fastening to a barrel, not shown in FIG. 1A. It should be noted that the underlying concept of the exemplary embodiment(s) of the present invention would not change if one or more components (or units) were added to or removed from diagram 100.

As paintball 108 is loaded from loading port 118 to loading chamber 126 as indicated by numeral 120, detent 101 is able to receive or catch paintball 108 and subsequently position paintball 108 in a predefined location within loading chamber 126. The predefined location, which may be adjustable, is an optimal or ideal location for holding paintball 108 before it is being launched. The optimal location, in one aspect, provides least obstacles and/or frictions during the paintball launch or firing process. The optimal location also reduces and/or minimizes paintball damage or chopping during the launch process. Detent 101, in an alternative aspect, further prevents unintended paintball movements or rolling between loading chamber 126 and the firing chamber (or barrel) due to the movement of paintball gun.

Detent 101 includes a cover 102, a lever lock 104, a catcher 106, and a spring 112. Cover 102, in one embodiment, is coupled to the paintball assembly and configured to provide support to detent 101. Cover 102 is removable from outside of a paintball assembly and allows a user to access detent 101 for location adjustments. Depending on the applications, cover 102 can be fabricated by solid materials such as steel, plastic, alloy, ceramic, polymer, composite compounds, and the like. Spring 112 is used to couple cover 102 with lever lock 104.

Lever lock 104 is configured to pivot up and down in directions indicated by numeral 130 in response to pivot pin 110 and spring 112. Lever lock 104, in one embodiment, provides a physical and structure support to paintball catcher or catcher 106. As soon as a paintball is fired or launched, a new paintball moves into loading chamber 126 from loading port 118 in a direction indicated by numeral 120, catcher 106 together with lever lock 104 to receive the new paintball such as paintball 108. Depending on pivot pin 110 and the spring force provided by spring 112, paintball 108 is set or held in an optimal location before it is being fired. Paintball catcher 106 coupled to lever lock 104 extends into loading chamber 126 to hold and position paintball 108 in such a way that it minimizes occurrence(s) of paintball chopping or damaging.

The paintball catcher or catcher 106, in one embodiment, is shaped as a hook-shaped latch or bar with a relatively smooth surface capable of restraining the movement of a paintball while does not damage the paintball. Paintball catcher 106 can be made of various types of material to provide best catching capability based on the properties of the paintball used. For example, paintball catcher 106 may be made of an elastically flexible substance such as hardened rubber. Alternatively, catcher 106 may be made of plastic, polymer, steel, alloy, or rubber depending on the applications. Catcher 106, for instance, is flexible enough to deform or change its shape in directions indicated by numeral 132. It should be noted that catcher 106 can be formed in different shapes and dimensions to optimize the ability of stabilizing the paintball in loading chamber 126.

Spring 112 coupling cover 102 and lever lock 104 provides necessary force for lever lock 104 and paintball catcher 106 to catch and to retain the paintball in a predefined position in loading chamber 126. In one embodiment, the force induced by spring 112 is adjustable such that the force for catching and retaining a paintball can be fine tuned for different types of paintballs. For example, the paintballs can be hard, brittle, or soft spherical-shaped objects. Spring 112 may be made of steel, plastic, composite material, alloy, and polymers. In one aspect, spring 112 can be replaced with other types of elastic bar or latch which are able to function as a spring.

Referring back to FIG. 1A, loading chamber 126 is coupled to loading port 118 to receive paintball 108. The paintballs are generally spherical-shaped capsules containing dye mixed in non-toxic and water-soluble substances. Alternatively, the paintballs can also be bullet-shaped capsules, elongated egg-shaped capsules, rocket-shaped capsules with wings/fins, and the like. The paintball's shell can be made of soft or brittle material and will break apart to release the dye content in the capsule upon impacting a target to leave color marks. Before being loaded, the paintballs such as paintball 108 are stored in an ammunition magazine or hopper which is attachable to loading port 118. The ammunition magazine carries multiple paintballs and some magazines are disposable. The paintballs can be fed by gravity, for example, from a top loader or hopper. Alternatively, the paintballs can be fed by forced-feed, for example, from a bottom-feed magazine.

Bolt 114, which is connected to a hammer as part of a paintball projectile propulsion system, is used to push paintball 108 from loading chamber 126 to the firing chamber for firing. Barrel coupler system 116 connects the body of paintball assembly to a gun barrel wherefrom the projectile or paintball leaves or exits from the paintball gun(s). As firing is commenced, while paintball catcher 106 releases paintball 108, bolt 114 traveling in a direction indicated by arrow 124 pushes paintball 108 into a firing chamber or a barrel in a direction 122 before launching paintball 108.

Figure 1B:
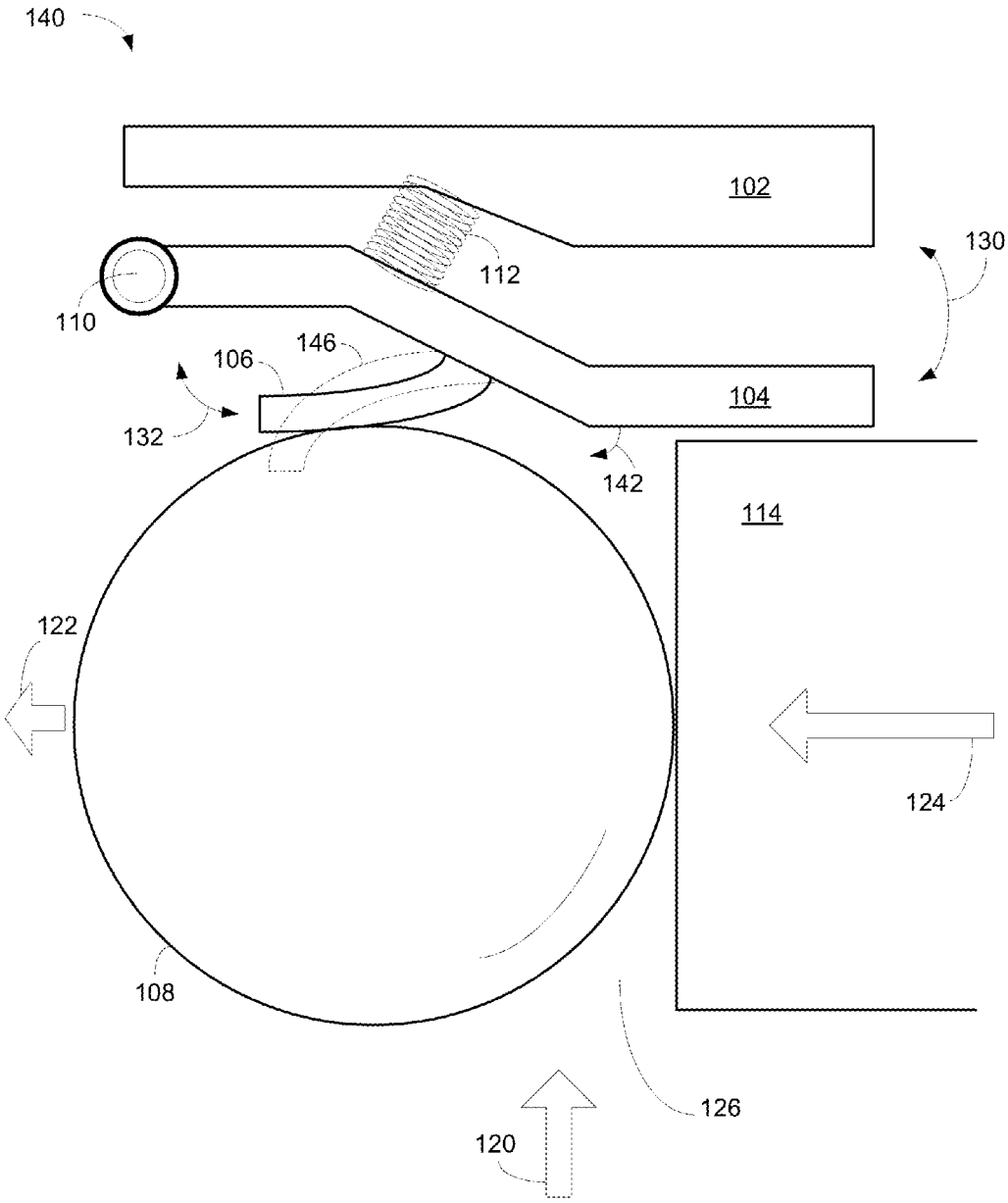
FIG. 1B is a diagram illustrating a paintball being pushed into the barrel while the detent releases the paintball in accordance with one embodiment of the invention.

FIG. 1B is a diagram 140 illustrating a paintball being pushed into the barrel while the detent releases the paintball in accordance with one embodiment of the invention. Diagram 140 is similar to diagram 100 except that diagram 100 illustrates a paintball being held in the loading chamber while diagram 140 shows the paintball leaving the loading chamber. During a firing or launching operation, bolt 114 moves forward in a direction indicated by arrow 124 and pushes paintball 108 from the loading chamber to the barrel or firing chamber, not shown in FIG. 1B, in a direction indication by arrow 122 for firing.

Catcher 106, in one embodiment, is a flexible paintball catcher which has sufficient strength or physical stiffness as shown in a dotted-line 146 to hold a paintball in loading chamber 126, and deforms its shape when paintball 108 is pushed by bolt 114 in a direction 124. Flexible paintball catcher 106 deforms part of its structure upwards in a direction indicated by arrow 132 and releases paintball 108 by the flexible paintball catcher.

When a catcher 106 is made of less flexible material, catcher 106 along with lever lock 104 can be configured to allow lever lock 104 to move upward pivoting around pivot pin 110 and release paintball 108 when the paintball is pushed. Spring 112, for example, may be compressed to pull lever lock 104 upward for releasing paintball 108. After paintball 108 is launched via the barrel, bolt 114 retreats back to its standby position. Before a new paintball is reloaded, lever lock 104 pivots downward into the loading chamber with respect to pivot pin 110 and spring 112.

Figure 1C:
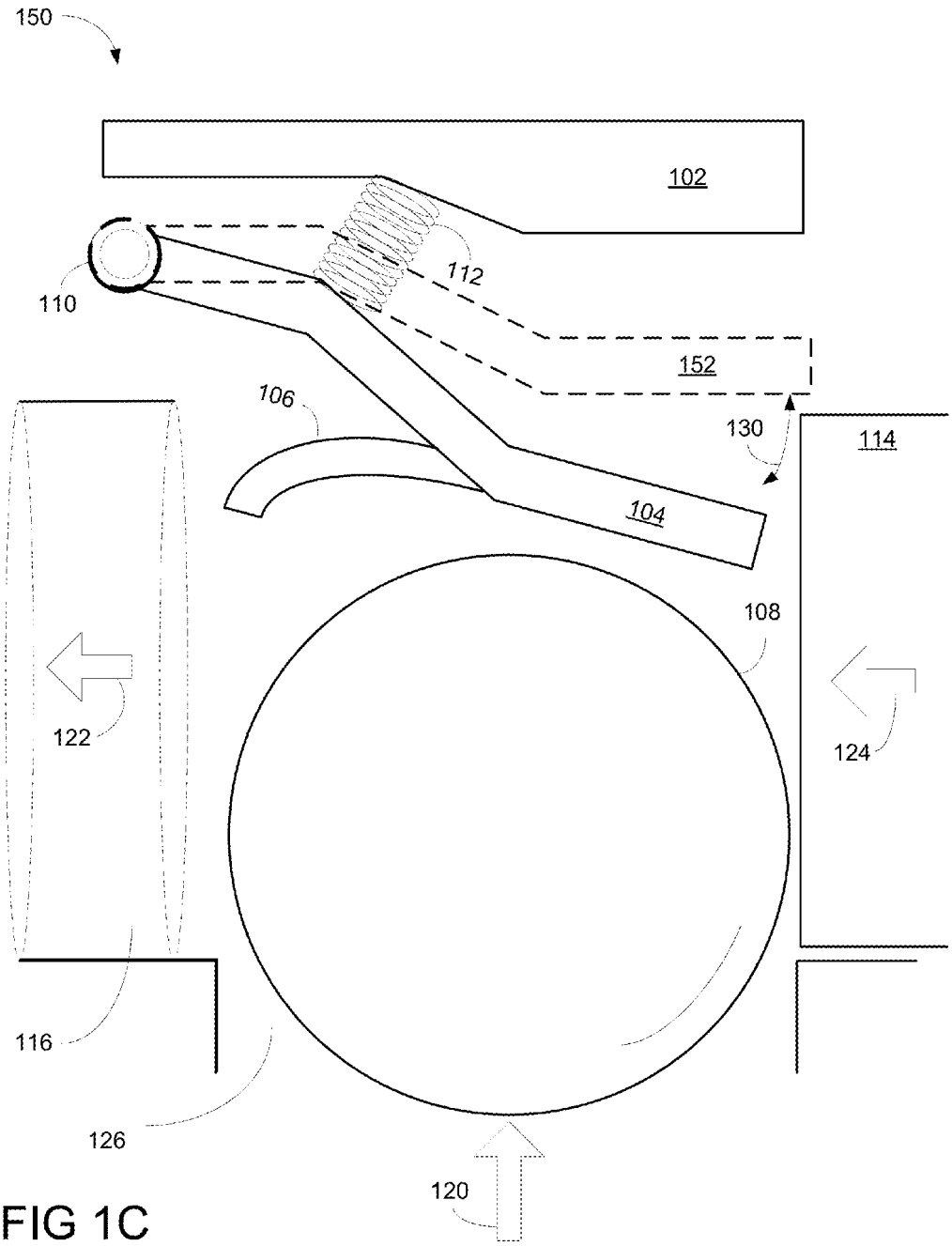
FIG. 1C is a diagram illustrating a detent of a paintball assembly capable of receiving a paintball in accordance with one embodiment of the present invention.

FIG. 1C is a diagram 150 illustrating a detent of a paintball assembly capable of receiving a paintball in accordance with one embodiment of the present invention. Diagram 150 is similar to diagram 100 except that diagram 150 shows a scenario of paintball reloading. For example, a detent is in a standby position while a paintball is loaded into a loading chamber. After releasing a paintball, lever lock 104 pivots downward in a direction toward to the loading port. Spring 112, in one embodiment, is calibrated to allow how far lever lock 104 is permitted to pivot down into the loading chamber. When lever lock 104 is in a pivoting down position, the pivoting down position blocks or prevents bolt 114 from moving. The pivoting down position also damps movements of the paintball before securing paintball 108 in the predefined location.

When lever lock 104 pivots down, the detent prevents the paintball marker from firing since paintball(s) has not been loaded in the loading chamber. The pivoting down of lever lock 104 blocks or at least partially blocks the passage of bolt 114 which extends from the loading chamber to the firing chamber in a barrel. The passage is cleared when paintball 108 is properly loaded and secured in the loading chamber. As shown in diagram 100, paintball catcher 106 and lever lock 104 which is in position 152 are in launching position when a paintball is properly secured.

When paintball 108 moves from the loading port in a direction 120 from a magazine into loading chamber 126, paintball 108 contacts lever lock 104 and paintball catcher 106. Paintball 108 continues to move up pushing lever lock 104 and catcher 106 toward cover 102. Spring 112 generates a force against the paintball movement whereby slowing down the paintball and eventually stopping the paintball's movement. In one embodiment, the spring force is tuned in such a way that the paintball stops at a balanced or optimal position, wherein paintball catcher 106 and lever lock 104 catch and secure the paintball at a location aligned with the firing mechanism. In one embodiment, the flexible paintball catcher 106 deforms or flexes a portion of the extended prong to accommodate and restrain the paintball in loading chamber 126.

Figure 2A:
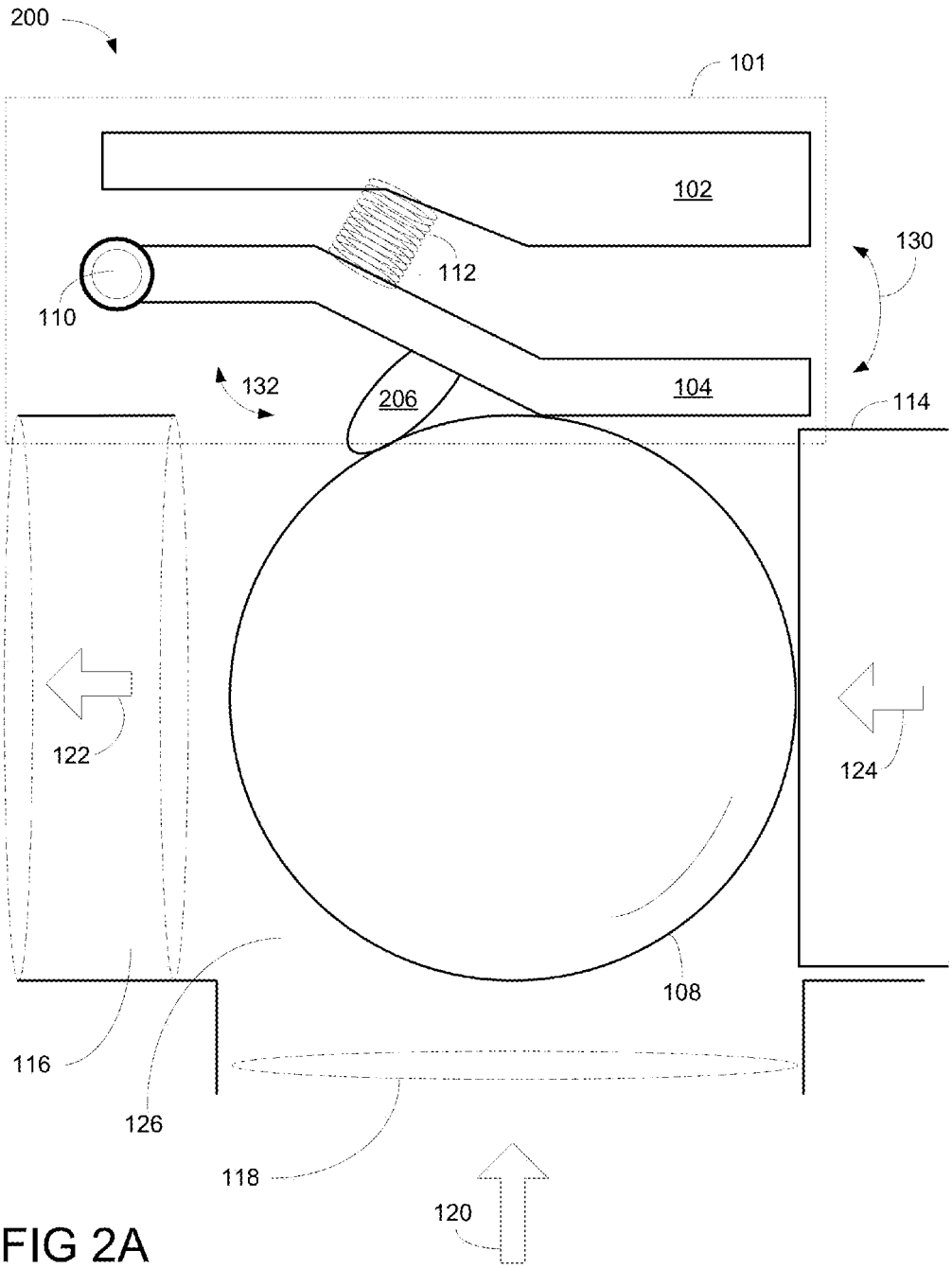
FIG. 2A a diagram illustrating a paintball assembly having a detent in accordance with one embodiment of the present invention.

FIG. 2A is a block diagram 200 illustrating a paintball assembly having a detent in accordance with one embodiment of the present invention. Diagram 200 illustrates similar elements as diagram 100 except that diagram 200 shows a different catcher 206. Diagram 200 includes a detent 101, a loading chamber 126, a paintball 108, and a bolt 114. Loading chamber 126 is further coupled with a loading port 118 and a barrel coupling system 116. Detent 101 includes a cover 102, a lever lock 104, and a catcher 206. It should be noted that the underlying concept of the exemplary embodiment(s) of the present invention would not change if one or more components (or units) were added to or removed from diagram 200.

Catcher 206, in one embodiment, is an elongated oval shape configured to restrain a paintball's movement when the paintball such as paintball 108 is in contact with catcher 206. In one example, lever lock 104 which houses catcher 206 may be fabricated in a single unit. Catcher 206 is flexible capable of stretch when a force applies to it, and can be made of elastic materials, such as rubber, plastic, polymer, composite substances, et cetera. Alternatively, catcher 206 is made of solid materials, such as steel, iron, aluminum, plastic, polymer, alloy, and the like.

Catcher 206, in an alternative embodiment, is controlled by a latch, not shown in FIG. 2A, and the latch, which is connected with a trigger or bolt 114, is able to left catcher 206 up (and down) to release paintball 108. Depending on the applications, catcher 206 can be fabricated in different shapes, such as a triangle, square, rectangular, column, circular, hexagon, or a combination of triangle, square, rectangular, column, circular, or hexagon. It should be noted that lever lock 104, cover 102, and catcher 206 may be integrated into one unit.

Figure 2B:
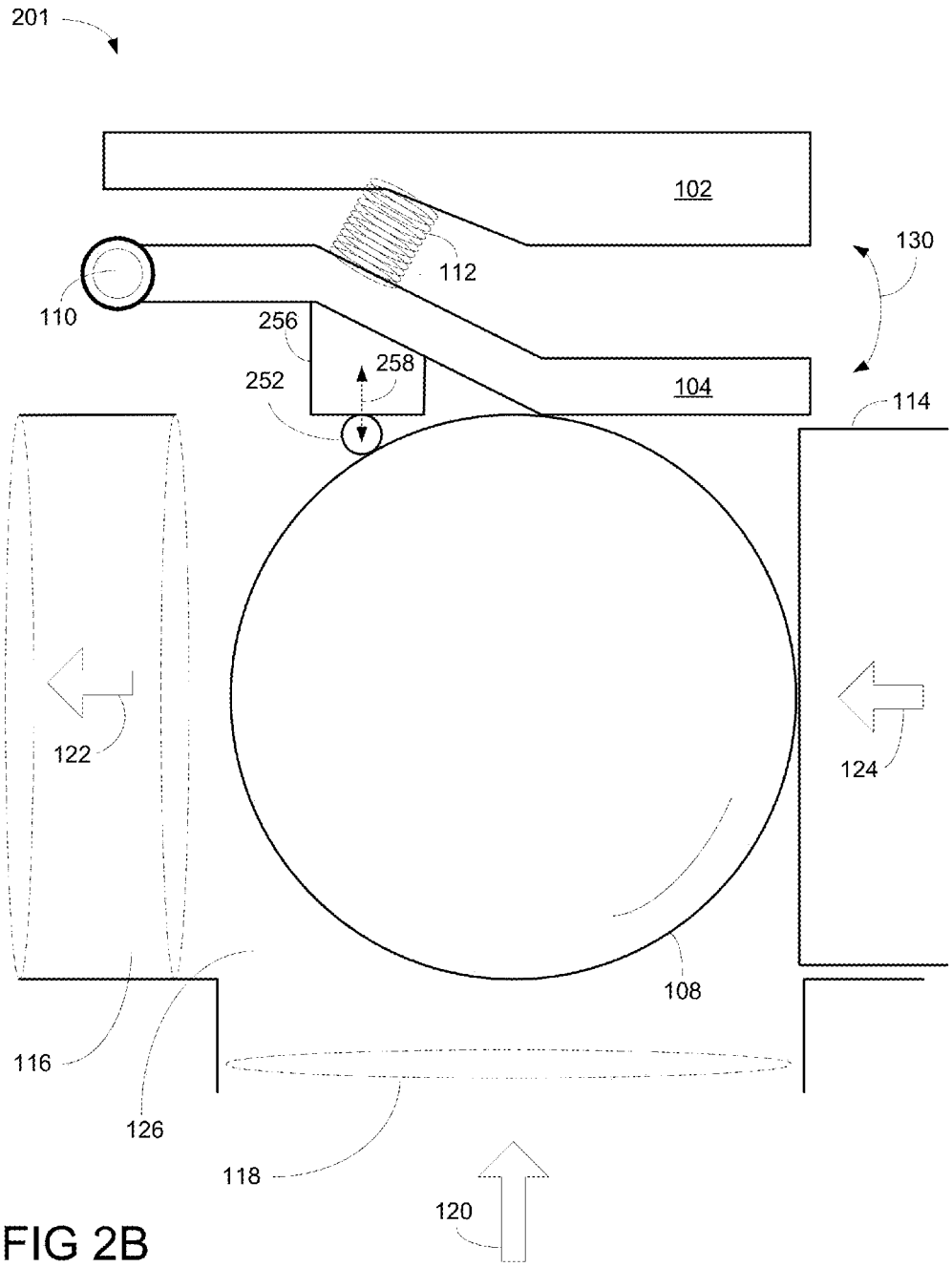
FIG. 2B a diagram illustrating a paintball assembly having a detent using an electrical switch in accordance with one embodiment of the present invention.

FIG. 2B is a block diagram 201 illustrating a paintball assembly having a detent using an electrical switch in accordance with one embodiment of the present invention. Diagram 201 illustrates similar elements as diagram 200 except that diagram 201 shows a catcher 256 having an electrical switch. Diagram 201 includes cover 102, lever lock 104, spring 112, paintball 108, loading chamber 126, and bolt 114. Catcher 256, in one embodiment, is an electrical switch capable of restraining and releasing paintball 108 in response to an electrical current.

Catcher 256, in one embodiment, includes a catching tip 252 wherein catching tip 252 moves up and down in a direction indicated by arrow 258. For example, when the electrical current is low, catching tip 252 is in downward position which restrains the movement of paintball 108. When the electrical current is high, catching tip 252, for example, releases paintball 108. In an exemplary situation, catcher 256 includes a solenoid which is able to control the actuation of catcher tip 252 in response to the electrical current.

The electrical current, in one aspect, may be generated and/or controlled by bolt 114. Alternatively, the trigger of paintball gun may be used to control the electrical current. To improve the performance of paintball gun, a combination of mechanical, electrical, and optical components may be used to more accurately align and control paintball 108 with the propelling/firing mechanism.

Figure 3A:
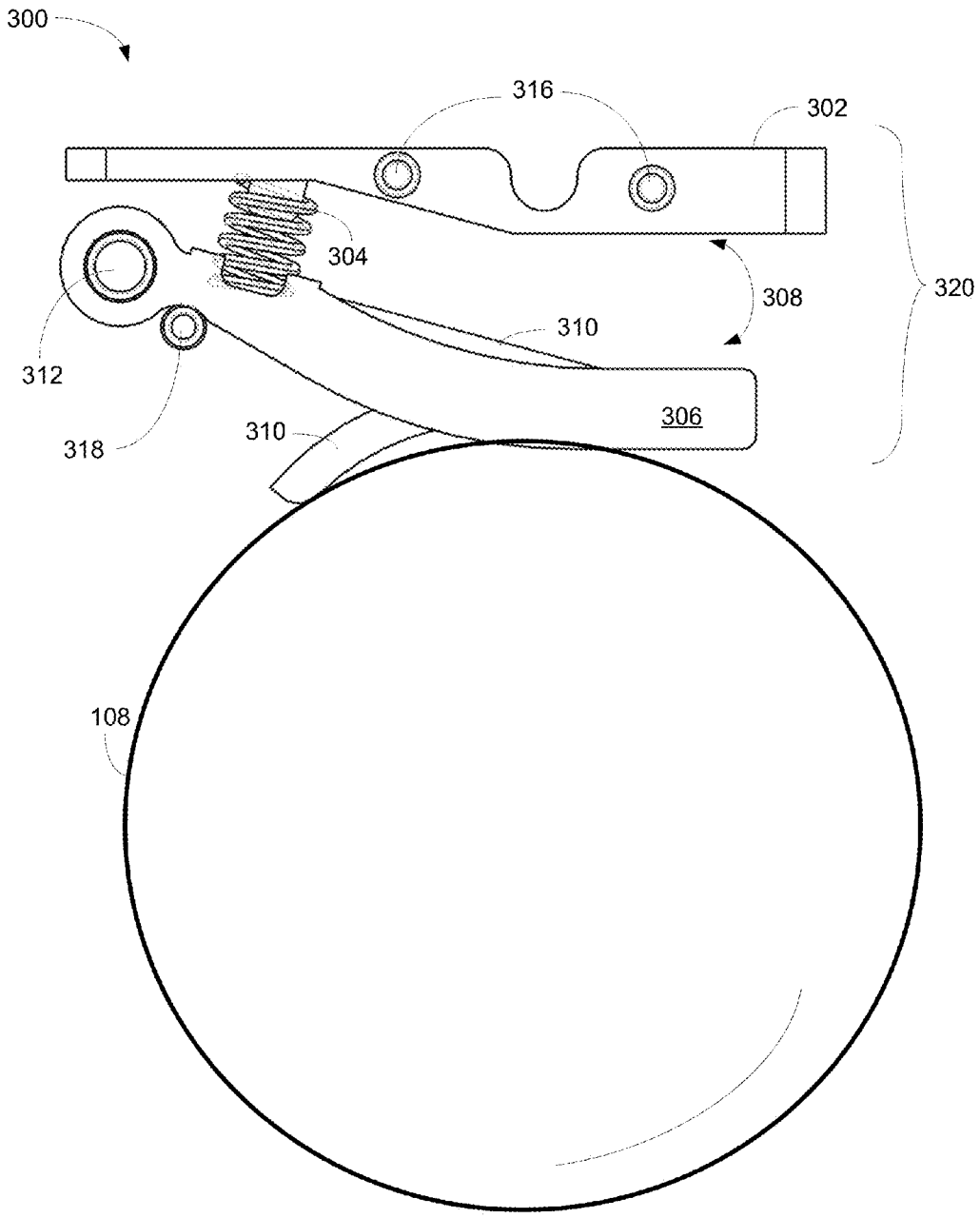
FIG. 3A is a diagram illustrating an exemplary detent 320 capable of catching and retaining a paintball in accordance with one embodiment of the invention.

FIG. 3A is a diagram 300 illustrating an exemplary detent 320 capable of catching and retaining a paintball in accordance with one embodiment of the invention. Diagram 300 includes a detent 320 and a paintball 108 wherein detent 320 further includes a cover 302, a spring 304, a lever lock 306 and a paintball catcher 310. Cover 302 also includes pin holes 316 for accepting pins to attach or anchor cover 302 to a paintball assembly. Lever lock 306 is held in position by a pivot pin 312 inserted into a pivot hole, a stop-pin 318, and spring 304. Pivot pin 312 and stop pin 318 are used to anchor or assemble lever lock 306 in such a way that lever lock 306 is allowed to move in a direction indicated by arrow 308.

Paintball catcher 310 having at least one extended prong is coupled to lever lock 306. Spring 304 is used to couple cover 302 to lever lock 306 and provides a flexible force required to pivot lever lock 306 against pivot pin 312 and stop pin 318. During the loading and releasing of a paintball, lever lock 306 is allowed to pivot around pivot pin 312 and stop pin 318. The force induced by spring 304 may be adjustable whereby the force for catching and retaining a paintball can be altered to accept different kinds of paintballs.

Paintball catcher 310, in one embodiment, is a flexible prong with relatively smooth surface capable of catching and restraining movement of a paintball while minimizing paintball damage or chop. Paintball catcher 310 is made of various different types of material, such as rubber, plastic, aluminum, polymer, cloth, wood, and the like. The prong of catcher 310, for instance, is sufficiently flexible or elastic whereby the prong deforms when paintball 108 is pushed by the bolt. It should be noted that the prong of catcher 310 can be formed in different shapes and dimensions to optimize the ability of stabilizing the paintball in loading chamber 126.

Figure 3B:
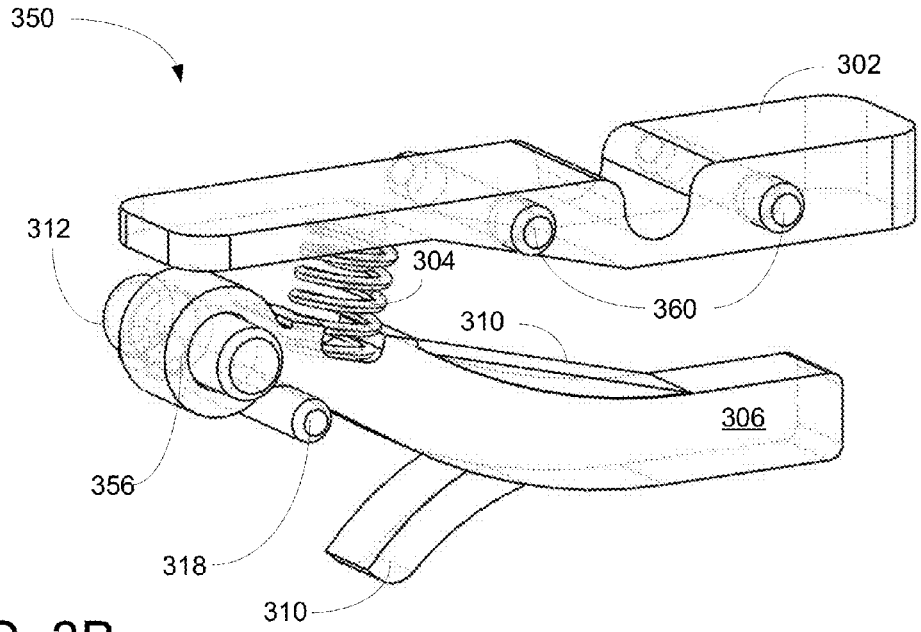
FIGS. 3B-C are three dimensional ("3D") perspective diagrams illustrating detents in accordance with one embodiment of the present invention.
Figure 3C:
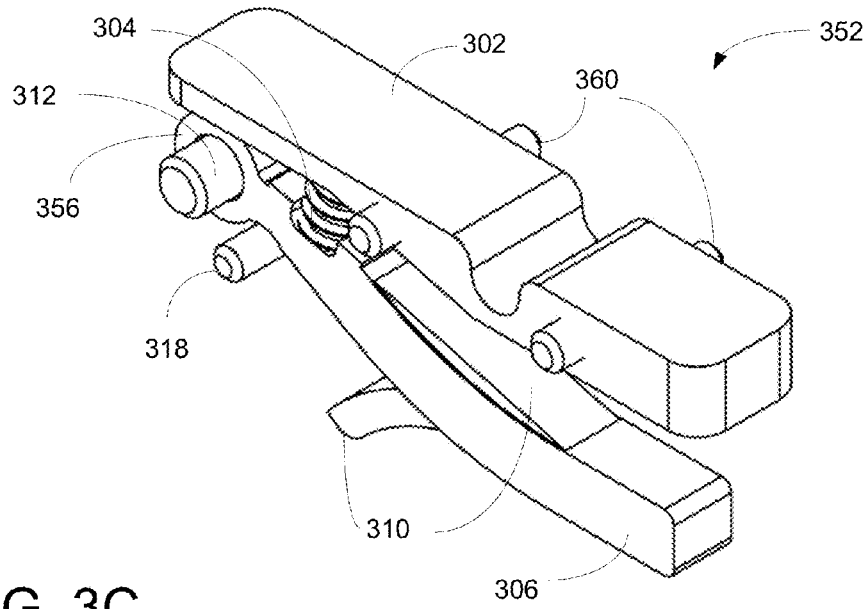

FIGS. 3B-C are three dimensional ("3D") perspective diagrams illustrating detents 350-352 in accordance with one embodiment of the present invention. Detents 350-352 show detent 320 in 3D wherein pins or shafts 360 are inserted to anchor or install cover 302 to the paintball assembly, not shown in FIGS. 3B-C. Pivot pin or shaft 312 is inserted in pivot 356 and allows lever lock 306 to pivot between stop pin 318 and cover 302. Prong of flexible catcher 310 is snapped or inserted into lever lock 306 wherein catcher 310 can be flexible while lever lock 306 is less flexible or rigid. Alternatively, catcher 310 and lever lock 306 can be manufactured as a single unit. Detent 352 illustrates a different 3D perspective view of detent 320 from another angle.

Figure 4:
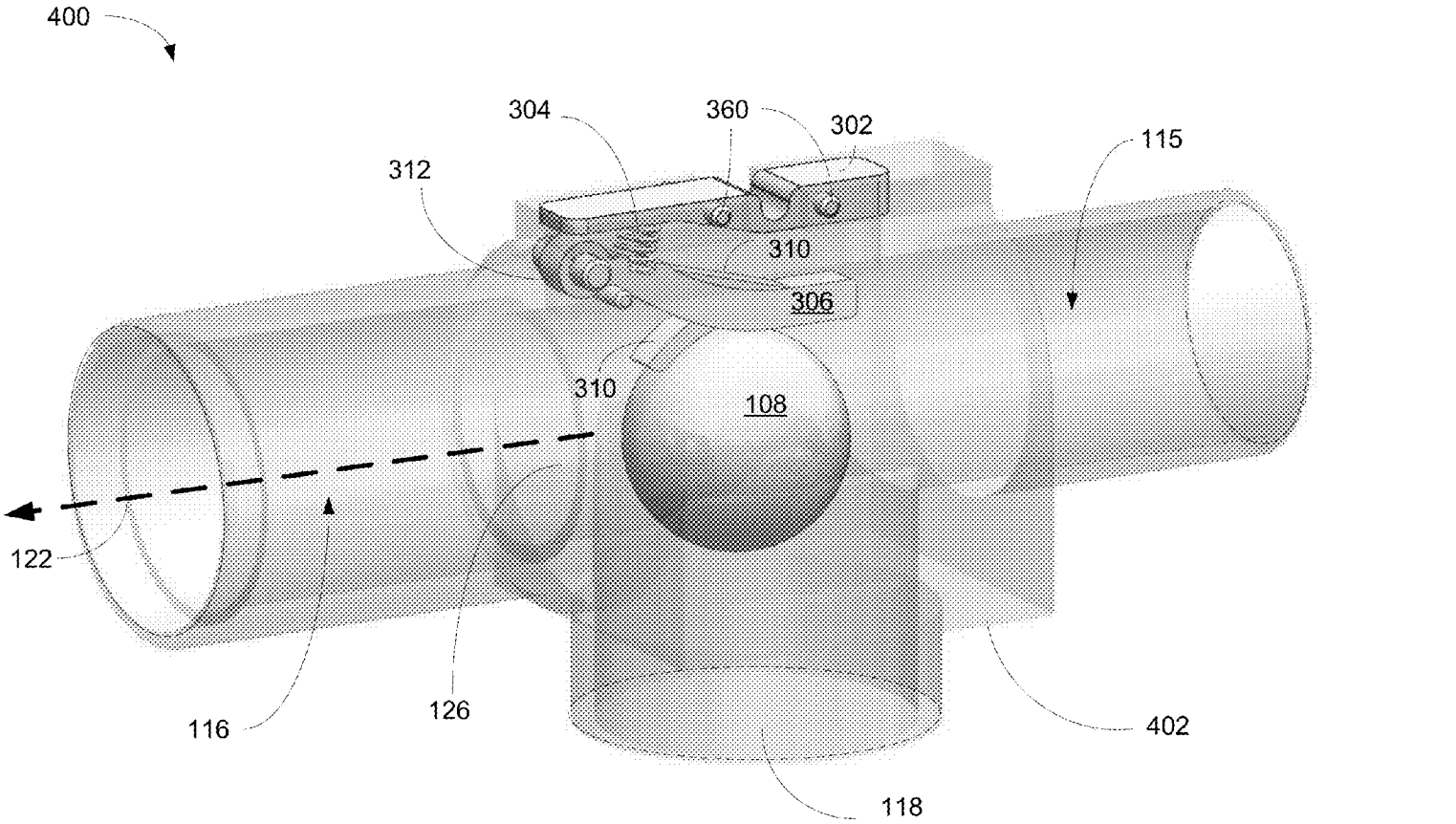
FIG. 4 is a 3D perspective diagram illustrating a paintball magazine feed adaptor showing a partial internal view of a paintball assembly in accordance with one embodiment of the invention.

FIG. 4 is a 3D perspective diagram 400 illustrating a paintball magazine feed adaptor showing a partial internal view of a paintball assembly in accordance with one embodiment of the invention. Diagram 400 includes an adaptor body 402, a barrel coupler 116, an assembly coupler 115, and a detent. Adaptor body 402, in one embodiment, includes a loading chamber 126 configured to receive a paintball 108 from a magazine containing paintballs. Barrel coupler 116, coupled to a first side of adaptor body 402, is operable to couple to a barrel for launching the paintball. Assembly coupler 115, coupled to a second side of adaptor body 402, is configured to couple to a firing mechanism of an assembly. The detent, coupled to a third side (or top) of adaptor body 402, is capable of assisting to position and hold paintball 108 in the loading chamber.

Adaptor body 402, coupled to a fourth side or bottom side of adaptor body 402, includes a loading port 118 capable of coupling to a bottom feed magazine, not shown in FIG. 4. Note that adaptor body 402, barrel coupler 116 and assembly coupler 115 can be fabricated into a single unit. In one embodiment, adaptor body 402 can be packaged as a kit adaptable to various other types of existing paintball guns.

The detent includes a cover 302, a lever lock 306, a flexible catcher 310 wherein detent may be removable from adaptor body 402 and is capable of being adjustable to reduce paintball damage. In one aspect, the detent can be disassembled from outside of adaptor body 402, and spring 304 and lever lock 306 can be adjusted to reduce paintball damage. Referring back to FIG. 4, while cover 302 is positioned on the top portion of the detent, lever lock 306 is coupled to cover 302 and is configured to provide a least a portion of paintball control. Spring 304 is coupled between cover 302 and lever lock 306, and provides paintball position adjustment in loading chamber 126 to reduce the paintball damage before firing.

During operation, paintball 108 is loaded from loading port 118 in loading chamber 126 and is held in position by paintball catcher 310 and lever lock 306. Pins 360 are inserted to couple cover 302 to adaptor body 402. Paintball 108 is securely positioned in loading chamber 126 and is in alignment with the bolt and the barrel. During firing, paintball 108 is launched in a direction indicated by arrow 122.

Figure 5:
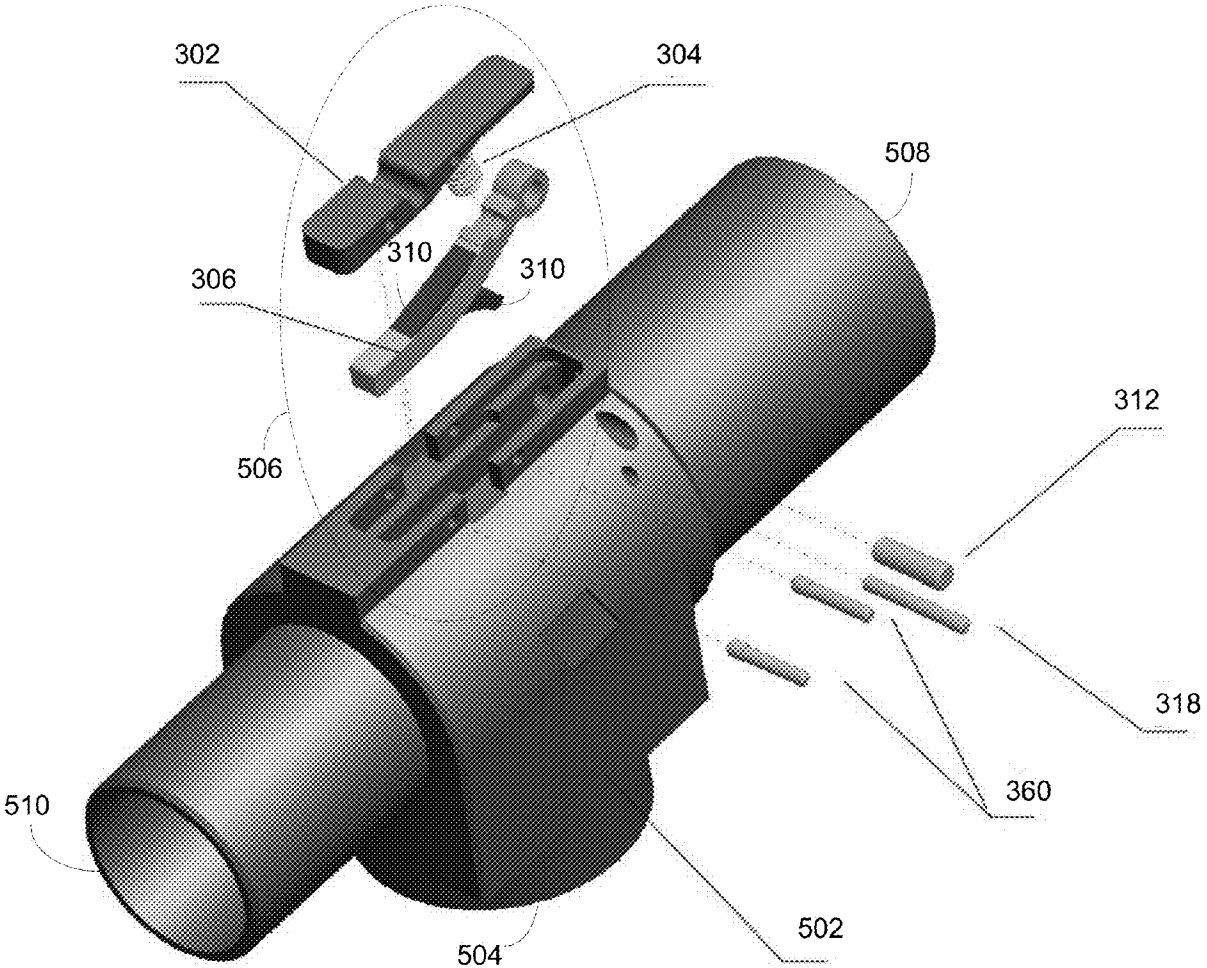
FIG. 5 is a 3D perspective diagram illustrating a paintball feed adaptor body having a detent in accordance with one embodiment of the invention.

FIG. 5 is a 3D perspective diagram illustrating a paintball feed adaptor body 502 having a detent 506 in accordance with one embodiment of the invention. Adaptor body 502 includes a barrel coupler, an assembly coupler 510, and a detent 506. Detent 506 can be anchored or assembled into adaptor body 502 using pins or shafts 312, 318, and 360. While loading port 504 couples to a paintball magazine, barrel coupler 508 couples to a barrel for launching a paintball. Assembly coupler 510 is configured to couple to a firing mechanism for propelling the paintball.

Figure 6:
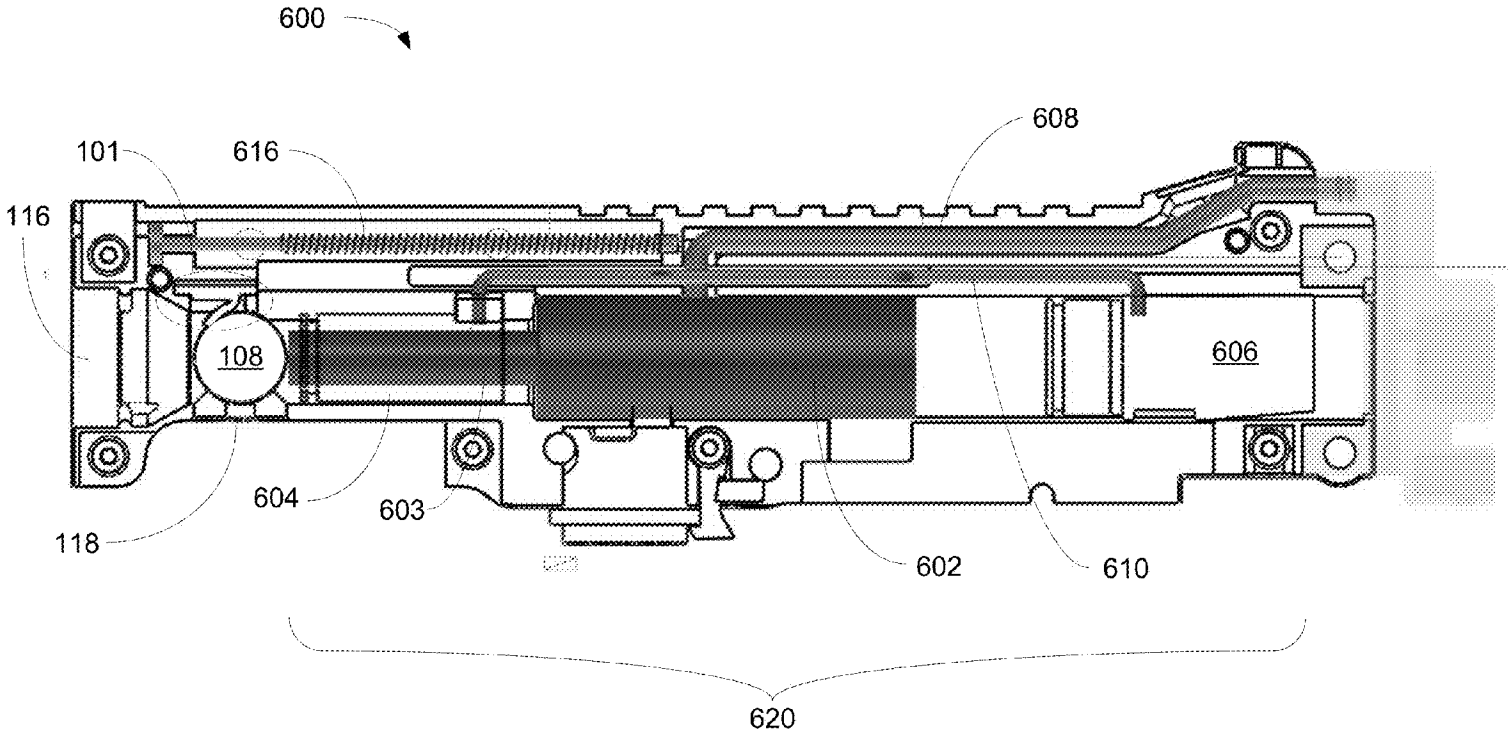
FIG. 6 is a longitudinal internal view showing a detent in a paintball assembly in accordance with one embodiment of the present invention.

FIG. 6 illustrates a longitudinal internal view showing a detent 101 in a paintball assembly in accordance with one embodiment of the invention. Paintball assembly 600 includes a projectile propel system or firing mechanism 620, a loading port 118, a barrel coupler 116 and a detent 101. It should be noted that the underlying concept of the exemplary embodiment(s) of the present invention would not change if one or more components (or elements) were added to or removed from diagram 600.

Projectile propelling system 620 includes valve 602, bolt 604, hammer 606, air pipe 68, and transfer rod 610. Valve 602, which has also been referred to as main valve, in-line valve, switch, et cetera, is able to launch, propel, throw, or hurl a paintball over a distance using a combination of cocking and firing mechanisms using pressurized gas. Valve 602 controls pressurized gas supplied from air pipe 608 and channels pressurized gas to propel a paintball over a distance via a barrel. A function of valve 602 is to switch on and/or off pressurized gas in response to the position of trigger.

Valve 602, in one embodiment, is structured in two cylindrical portions including an extended cylindrical portion 603. While main valve 602 controls the pressurized gas, extended cylindrical portion or extended portion 603 provides a track or direction to bolt 604 and provides directional guidance for the movement of bolts 604. Note that valve 602, extended portion 603, bolt 604, and hammer 606 are all axially aligned with the breech end of a barrel.

During an operation, as the paintball 108 is received from loading port 118, detent 101 catches and retains the paintball 108 in the loading chamber and secures it at a position aligned axially with the firing mechanism 620. After the cocking device 616 pushes the hammer 606 and the bolt 604 to their firing positions, the paintball assembly 600 is now armed and ready to launch the paintball 108. When a trigger is pulled, the bolt 604 and the hammer 606, connected by the transfer rod 610, move forward, and guides or pushes the paintball 108 into a firing chamber through the barrel coupler 116 while the detent 101 releases the paintball 108 from its secured position. The forward movement of the hammer 606 also manages or controls the main valve 602 to releases the pressurized gas supplied by the air pipe 608 to launch the paintball 108. The transfer rod 610 is used to synchronize the movement of the bolt 604 and the hammer 606.

Figure 7:
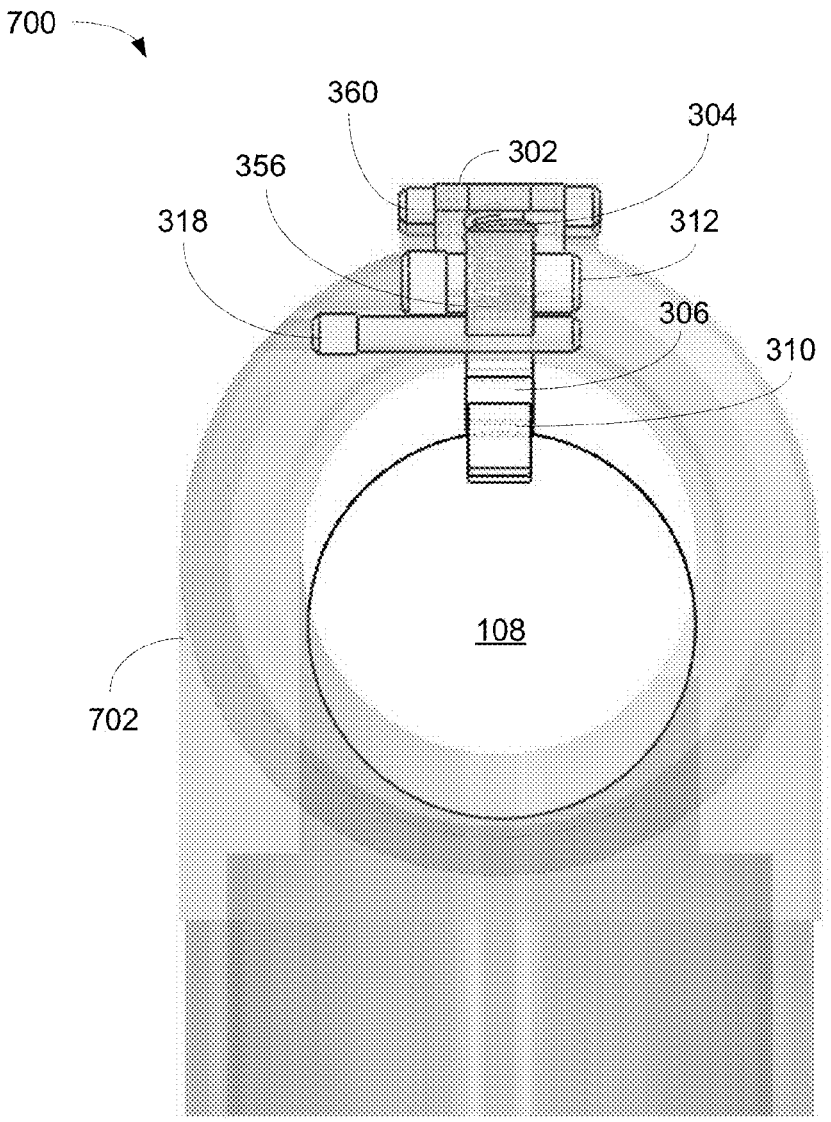
FIG. 7 illustrates a diagram showing a front view of a paintball caught and secured by a detent installed in a paintball assembly in accordance with one embodiment of the invention.

FIG. 7 illustrates a diagram showing a front view 700 of a paintball 108 held or secured by a detent of a paintball assembly 702 in accordance with one embodiment of the invention. The detent includes a cover 302, a spring 304, a lever lock 306 and a paintball catcher 306. Cover 302 is attached to paintball assembly 702 with various pins or shafts such as pins 360 and pin 312. Pivot pin 312 is inserted through pivot 356 to secure lever lock 306 with paintball assembly 702. Spring 304 and stop pin 318 provide limits of distance that lever lock 306 can fluctuate.

Figure 8:
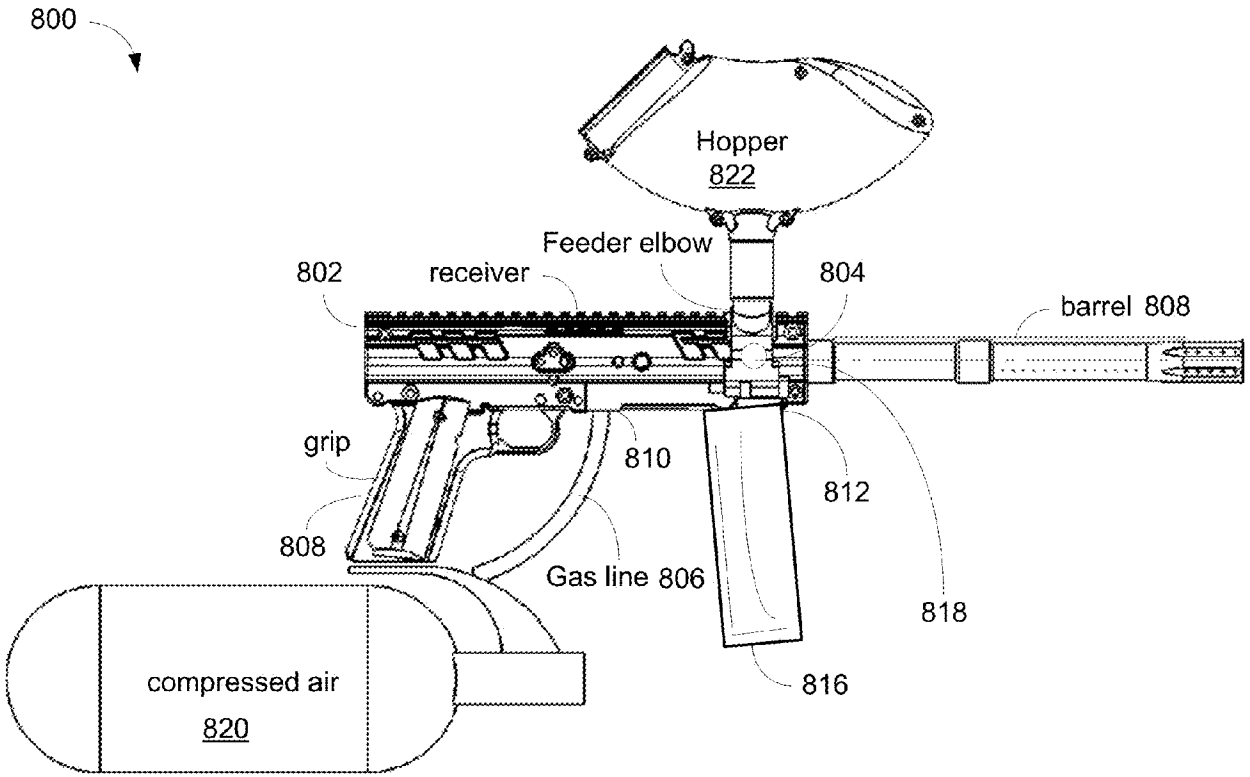
FIG. 8 is a diagram showing a paintball marker capable of catching and holding a paintball in accordance with one embodiment of the invention.

FIG. 8 is a diagram 800 showing a paintball marker capable of catching and holding a paintball in accordance with one embodiment of the invention. Diagram 800 includes a receiver, a feeder elbow, a hopper 822, a compressed air container 820, a barrel 808, a gas line 806, a bottom feed magazine 816, and a paintball assembly 804. A paintball marker operator can optionally elect to use either the top feed mechanism or bottom feed mechanism. In one embodiment, bottom feed magazine 816 couples to a bottom feed adapter and feeds paintballs to the chamber of receiver via bottom feed port 812. Paintball 818 loaded from magazine 816 can be secured in the loading chamber by a detent. In an alternative embodiment, paintball 818 loaded from hopper 822 can be secured in the loading chamber by a detent.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A paintball assembly comprising:

a loading chamber coupled to a loading port operable to receive a paintball;

a detent coupled to the loading chamber and configured to have a flexible paintball catcher extending into the loading chamber, wherein the flexible paintball catcher is able to catch the paintball moving from the loading port to the loading chamber and release the paintball via an electrical switch when the paintball moves from the loading chamber to the firing chamber through a push generated by the bolt, wherein the detent is removable from the adaptor body and capable of being adjustable to reduce paintball damage; and a bolt coupled to the loading chamber and operable to guide the paintball into a firing chamber while the flexible paintball catcher releases the paintball.

2. The assembly of claim 1, further comprising;

a valve coupled to the bolt and configured to provide pressurized gas; and a hammer coupled to the valve and configured to control the valve for propelling the paintball via the pressurized gas.

3. The assembly of claim 1, wherein the loading chamber is adjacent to the firing chamber is able to receive the paintball from a bottom feed magazine.

4. The assembly of claim 1, wherein the loading chamber is able to receive a paintball from a top feed hopper.

5. The assembly of claim 1, wherein the loading port is coupled to a magazine containing a plurality of paintballs.

6. The assembly of claim 1, wherein the paintball is a soft-shell capsule containing colored marker.

7. The assembly of claim 1, wherein the detent includes, a cover configured to be at least a part of a top portion of the detent;

a lever lock coupled to the cover and configured to provide at least a portion of paintball control; and a spring coupled between the cover and lever lock, and providing paintball position adjustment in the loading chamber to reduce paintball damage before firing.

8. The assembly of claim 1, wherein the flexible paintball catcher releases the paintball via elasticity of the flexible paintball catcher as the paintball proceeds from the loading chamber to the firing chamber through a push generated by the bolt.

9. The assembly of claim 1 wherein the electrical switch is a solenoid.

10. The assembly of claim 1, wherein the detent is operable to place the paintball in an optimal position in the loading chamber before the paintball is in motion for launch.

11. A paintball magazine feed adaptor comprising:

an adaptor body for paintball loading having a loading chamber capable of receiving a paintball from a magazine containing a plurality of paintballs;

a barrel coupler coupled to a first side of the adaptor body and operable to couple to a barrel for launching the paintball;

an assembly coupler coupled to a second side of the adaptor body and configured to couple to a firing mechanism of an assembly; and a detent, having a catcher, coupled to a third side of the adaptor body and capable of assisting to position and hold the paintball in the loading chamber, wherein the catcher releases the paintball via an electrical switch when the paintball moves from the loading chamber to the firing chamber through a push generated by the bolt, wherein the detent is removable from the adaptor body and capable of being adjustable to reduce paintball damage.

12. The adaptor of claim 11, further comprising a loading port coupled to a fourth side of the adaptor body and configured to couple to a bottom feed magazine.

13. The adaptor of claim 11, wherein the adaptor body, the barrel coupler, and the assembly coupler are fabricated as a single unit.

14. The adaptor of claim 11, wherein the detent is part of the adaptor body capable of being adjustable to reduce paintball damage.

15. The adaptor of claim 11, wherein the detent includes, a cover configured to be at least a part of a portion of the detent;

a lever lock coupled to the cover and configured to provide a least a portion of paintball control; and a spring coupled between the cover and lever lock, and providing paintball position adjustment in the loading chamber to reduce paintball damage before firing.

16. A paintball gun loading management device, comprising a cover configured to anchor to an adaptor, wherein the adaptor is congifured to be mounted proximate the loading chamber of the paintball gun; a spring having a first end and a second end wherein the first end of spring is coupled to the cover;

a lever lock coupled to the second end of the spring and configured to prevent a paintball assembly from firing before a paintball is loaded into a predefined location in a loading chamber.

17. The device of claim 16, further comprising a catcher coupled to the lever lock and configured to extend its prong into the loading chamber for catching the paintball.

18. The device of claim 17, wherein the catcher is flexible capable of deforming upon receiving a predefined amount of force.

* * * * *